US006083060A

United States Patent [19]

Chen et al.

[11] Patent Number: 6,083,060

[45] Date of Patent: Jul. 4, 2000

[54] DENSITY CONTACT STRIP AND PROCESS OF SEPARATION THEREOF

[75] Inventors: Hsiang-Ping Chen; Mu-An Yen, both of Lu-Chou; Tsung-Hsi Ou Lee, Taipei, all of Taiwan

[73] Assignee: Hon Hai Precision Ind. Co., Ltd., Taipei Hsien, Taiwan

[21] Appl. No.: 09/119,342

[22] Filed: Jul. 20, 1998

[30] Foreign Application Priority Data

Jul. 18, 1997 [TW] Taiwan ..... 86212163

[51] Int. Cl.[7] ..... H01R 9/24

[52] U.S. Cl. ..... 439/885; 439/876

[58] Field of Search ..... 206/717; 439/885, 439/701, 937, 557, 344, 544.5, 545; 29/879, 876

[56] References Cited

U.S. PATENT DOCUMENTS

| | | | |
|---|---|---|---|
| 4,369,572 | 1/1983 | Atkins | 439/885 |
| 4,428,642 | 1/1984 | Schwindt et al. | 439/885 |
| 5,848,920 | 12/1998 | Klein et al. | 439/885 |

*Primary Examiner*—Renee Luebke
*Assistant Examiner*—J. F. Duverne

[57] ABSTRACT

A contact strip includes a plurality of terminals (10) joined together by a material band (50). Each terminal (10) includes a connection portion (11) having a first contact portion (13) extending from one end thereof for reception in a receptacle connector (80) and a second contact portion (14) extending from another end thereof for engagement with a PCB. A pair of opposite cutting cutouts (30) is defined in each end of the connection portion (11) adjacent to the adjoining material band (50) for facilitating the separation of the terminals (10) from the contact strip by means of a cutter (90) cutting along a straight line "C".

10 Claims, 7 Drawing Sheets

DENSITY CONTACT STRIP AND PROCESS OF SEPARATION THEREOF

BACKGROUND OF THE INVENTION

1. Field of The Invention

The present invention relates to a contact strip, and particularly to a high density contact strip having an arrangement which facilitates the separation of each terminal therefrom by means of a cutter.

2. The Prior Art

Computers having a high processing speed and occupying a small space are the trend of computer technology development. To meet the trend, connectors are developed having a compact arrangement of terminals. Such terminals are commonly stamped from a metal sheet and are joined at a middle portion thereof by a material band wherein a small pitch exists between adjacent terminals. The terminals are then separated from the band by means of a cutter before they are inserted into a connector housing. However, due to the arrangement of the terminals along the contact strip, previous attempts at separating the terminals by cutting have caused problems.

Referring to FIG. 1, a contact strip having a small pitch between adjacent terminals is shown. Each terminal has a connection portion 1, and a material band 2 joins the connection portions 1 together. A rectangular cutout 3 having a width equal to the pitch of the terminals is defined between adjacent connection portions 1 and the band 2. The terminals are separated from the contact strip by cutting along a pitch line bordering the connection portion 1 and the band 2 as shown in FIG. 2 by the dotted line "A". Since the cutter must be exactly positioned along the line "A" to prevent an improper cut, a slight deviation in alignment of the contact strip with the cutter will result in an improperly formed terminal.

To address this problem the terminals are separated from the contact strip by cutting through the connection portion 1 a slight distance from the band 2 as indicated in FIG. 3 by dotted line "B". With this arrangement the cutter does not require such precise alignment, however, since the cutter separates the connection portion 1 from the band 2 along three faces, material stress is concentrated at the corners where the faces meet causing the material surrounding this area to improperly deform which may adversely affect the engagement of the terminal with the related connector. In addition, the life span of the cutter 7 as shown in FIG. 4 is significantly shortened due to the wear caused by the high operational speed of the cutter 7 repeatedly cutting along the three faces 4, 5, 6.

Hence, an improved contact strip is needed to eliminate the above mentioned problems associated with separating terminals from a conventional contact strip.

SUMMARY OF THE INVENTION

Accordingly, an objective of the present invention is to provide a high density contact strip wherein each terminal can be separated therefrom by cutting along only one line.

Another objective of the present invention is to provide a high density contact strip having terminals separated therefrom by a cutter whereby the life span of the cutter is extended.

A further objective of the present invention is to provide a high density contact strip wherein the distance between adjacent terminals is increased for facilitating the separation of each terminal therefrom by cutting.

To fulfill the above mentioned objectives, according to one aspect of the present invention a contact strip includes a plurality of terminals joined together by a material band. Each terminal includes a connection portion having a first contact portion extending from one end thereof for reception in a receptacle connector and a second contact portion extending from another end thereof for engagement with a PCB. Each connection portion forms two projections thereon for interferential engagement within the receptacle connector, and each material band defines a guiding hole therein for properly aligning the contact strip with a cutter before separating the terminals therefrom. A pair of opposite cutting cutouts are defined in each end of the connection portion adjacent to the adjoining material band for facilitating the separation of the terminals from the contact strip by means of the cutter along a straight line.

These and additional objectives, features, and advantages of the present invention will become apparent after reading the following detailed description of the preferred embodiment of the present invention taken in conjunction with the appended drawing figures.

DETAILED DESCRIPTION OF THE PREFERRED EMBODIMENT

Reference will now be made in detail to the preferred embodiment of the present invention.

Figure 1:
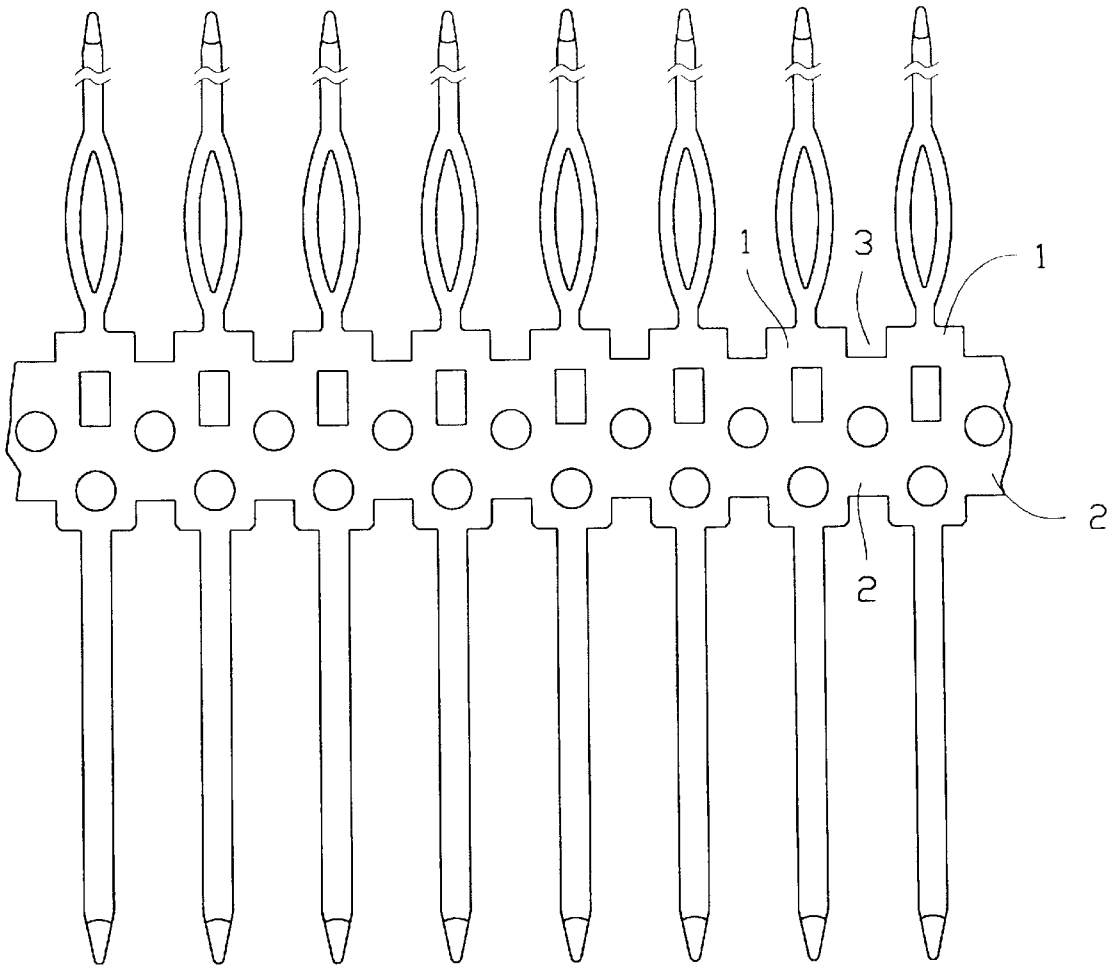
FIG.1 (PRIOR ART)
FIG. 1 is an elevational view of a conventional contact strip.
Figure 3:
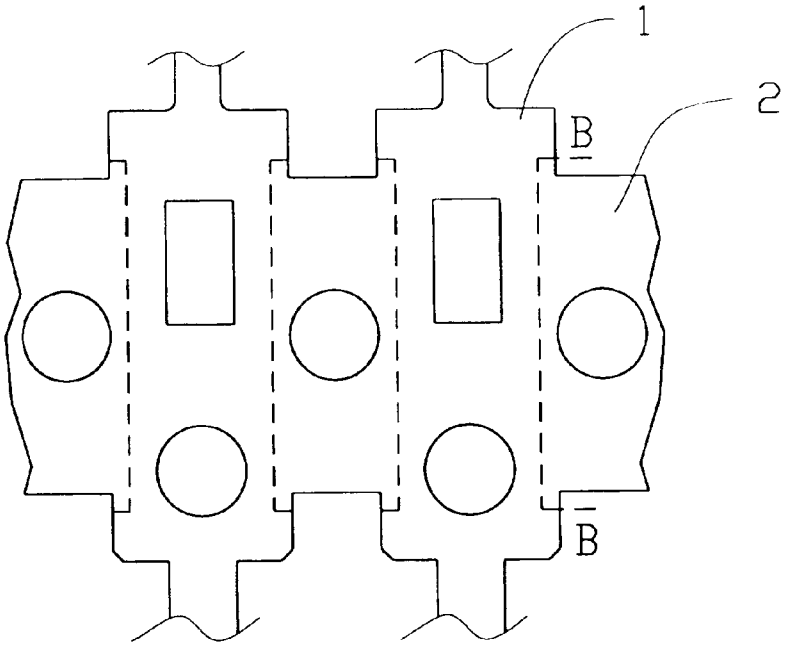
FIG.3 (PRIOR ART)
FIG. 3 is a view similar to FIG. 2 showing a different separation cut line.
Figure 2:
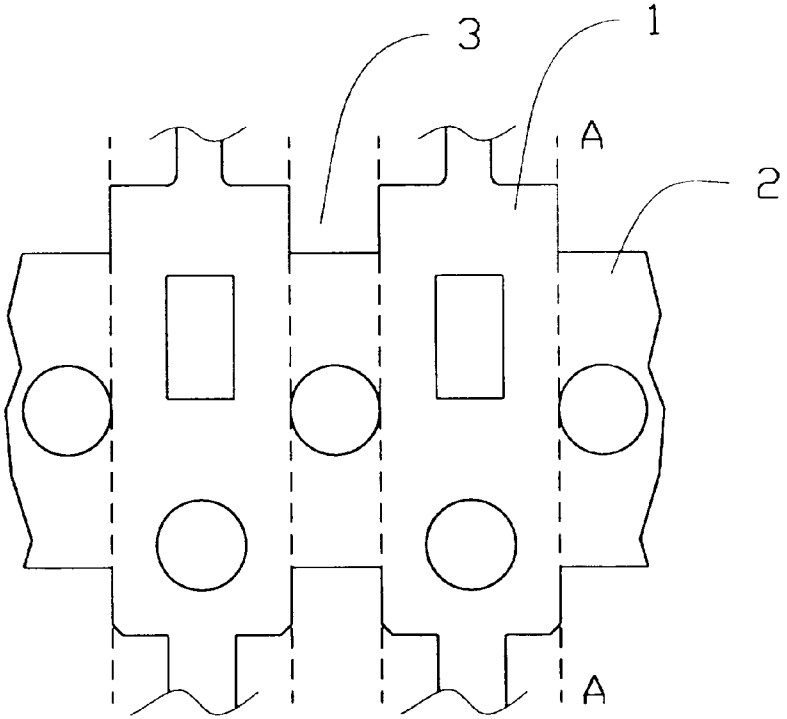
FIG.2 (PRIOR ART)
FIG. 2 is a partial enlarged view of FIG. 1 showing a separation cut line.
Figure 4:
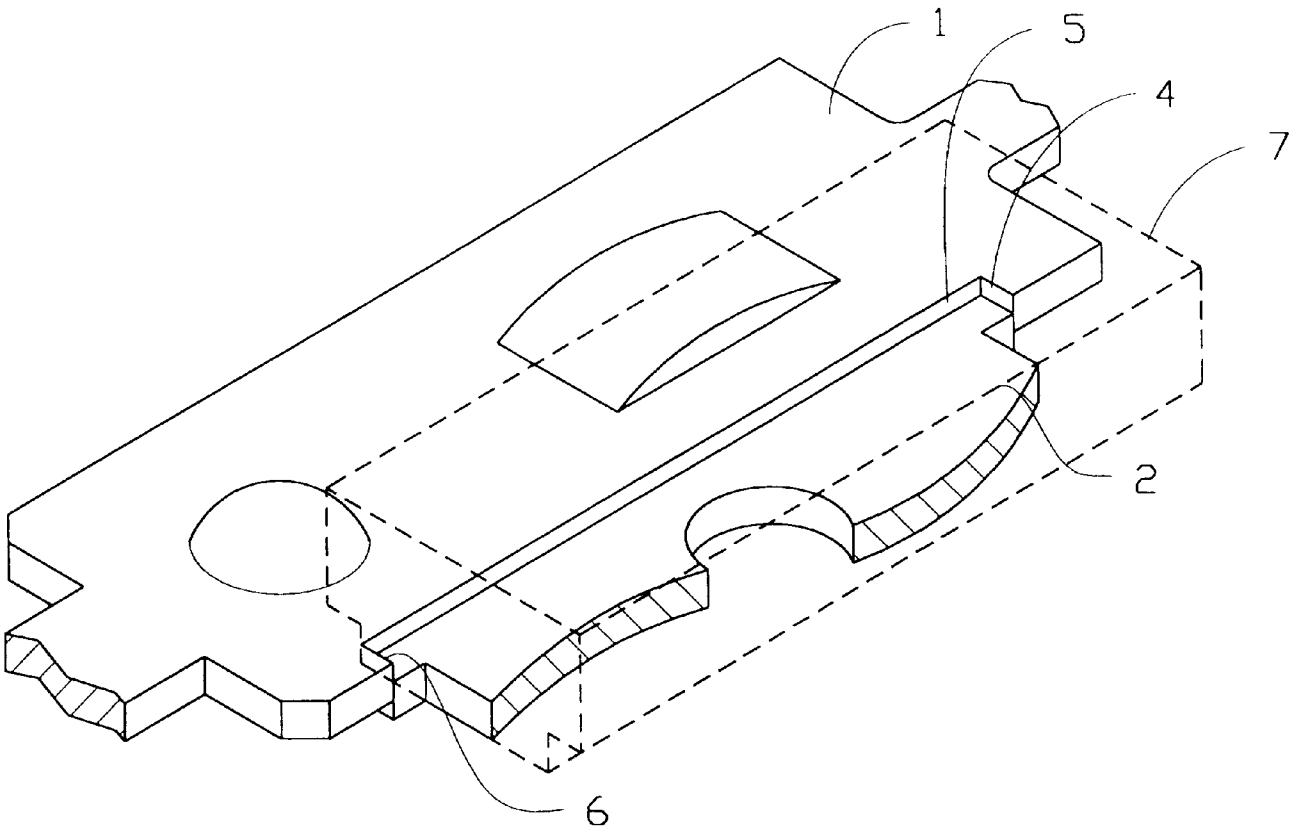
FIG. 4 (PRIOR ART)
FIG. 4 is a partial, perspective view of a conventional contact strip showing a cutter separating a connection portion of a terminal from a material band.
Figure 5:
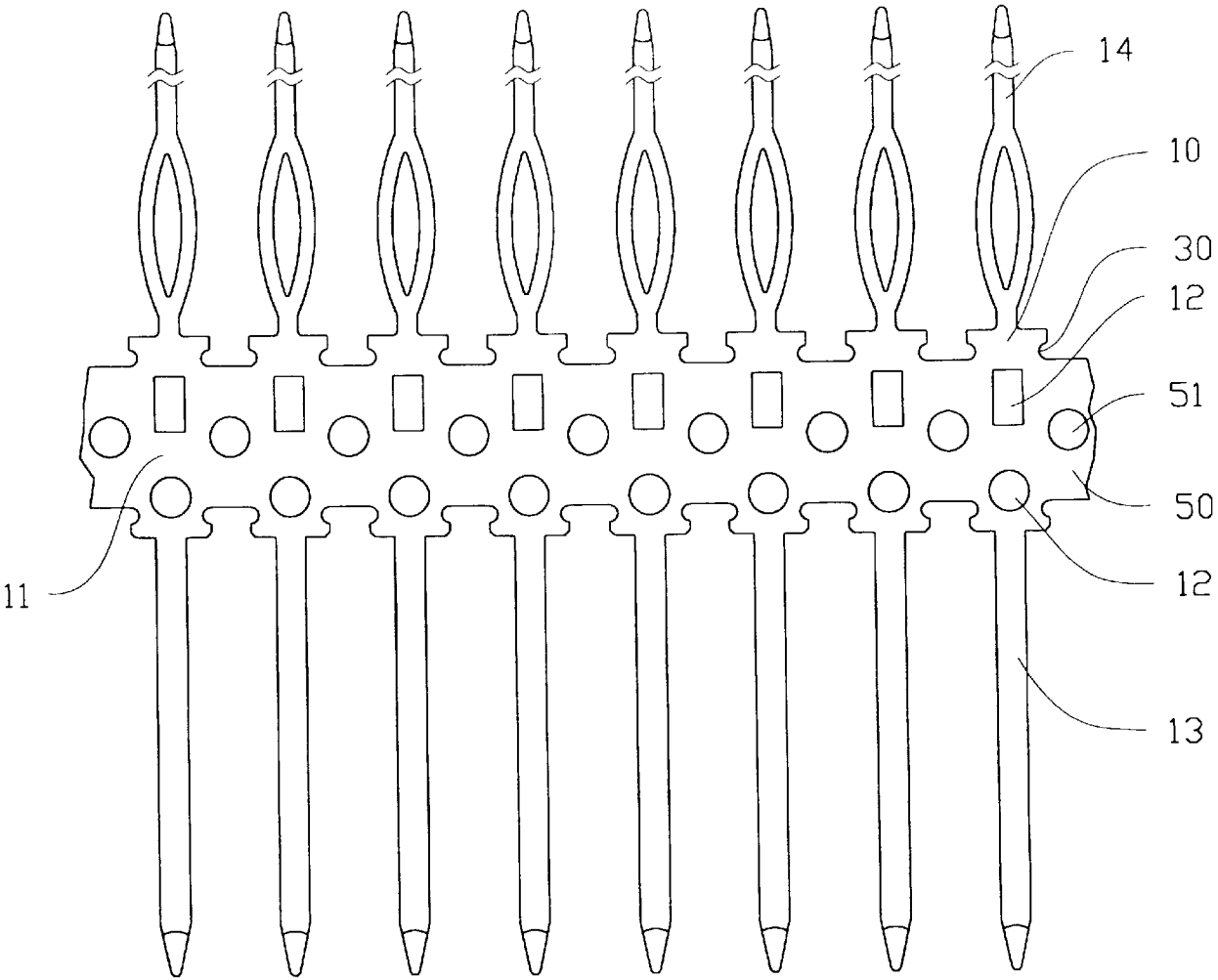
FIG. 5 is an elevational view of a contact strip in accordance with the present invention.
Figure 6:
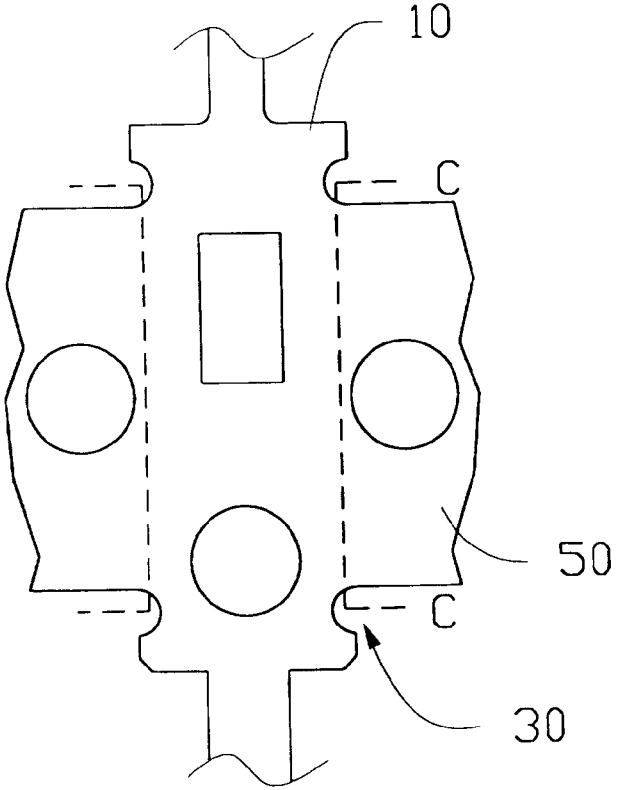
FIG. 6 is a partial, enlarged view of FIG. 5 showing a separation cut line thereof.

Referring to FIG. 5, a contact strip (not labeled) in accordance with the present invention includes a plurality of terminals 10 joined together by a material band 50. Each terminal 10 includes a connection portion 11 having a first contact portion 13 extending from one end thereof for reception in a receptacle connector 80 (shown in FIG. 8) and a second contact portion 14 extending from another end thereof for engagement with a PCB (not shown). Each connection portion 11 forms two projections 12 thereon for interferential engagement with the receptacle connector 80, and each material band 50 defines a guiding hole 51 therein for properly aligning the contact strip with a cutter 90 (shown in FIG. 7) before separating the terminals 10 therefrom. A pair of opposite cutting cutouts 30 are defined in each end of the connection portion 11 adjacent to the adjoining material band 50 for facilitating the separation of the terminals 10 from the contact strip by means of the cutter 90 along line "C" as shown in FIG. 6.

Figure 7:
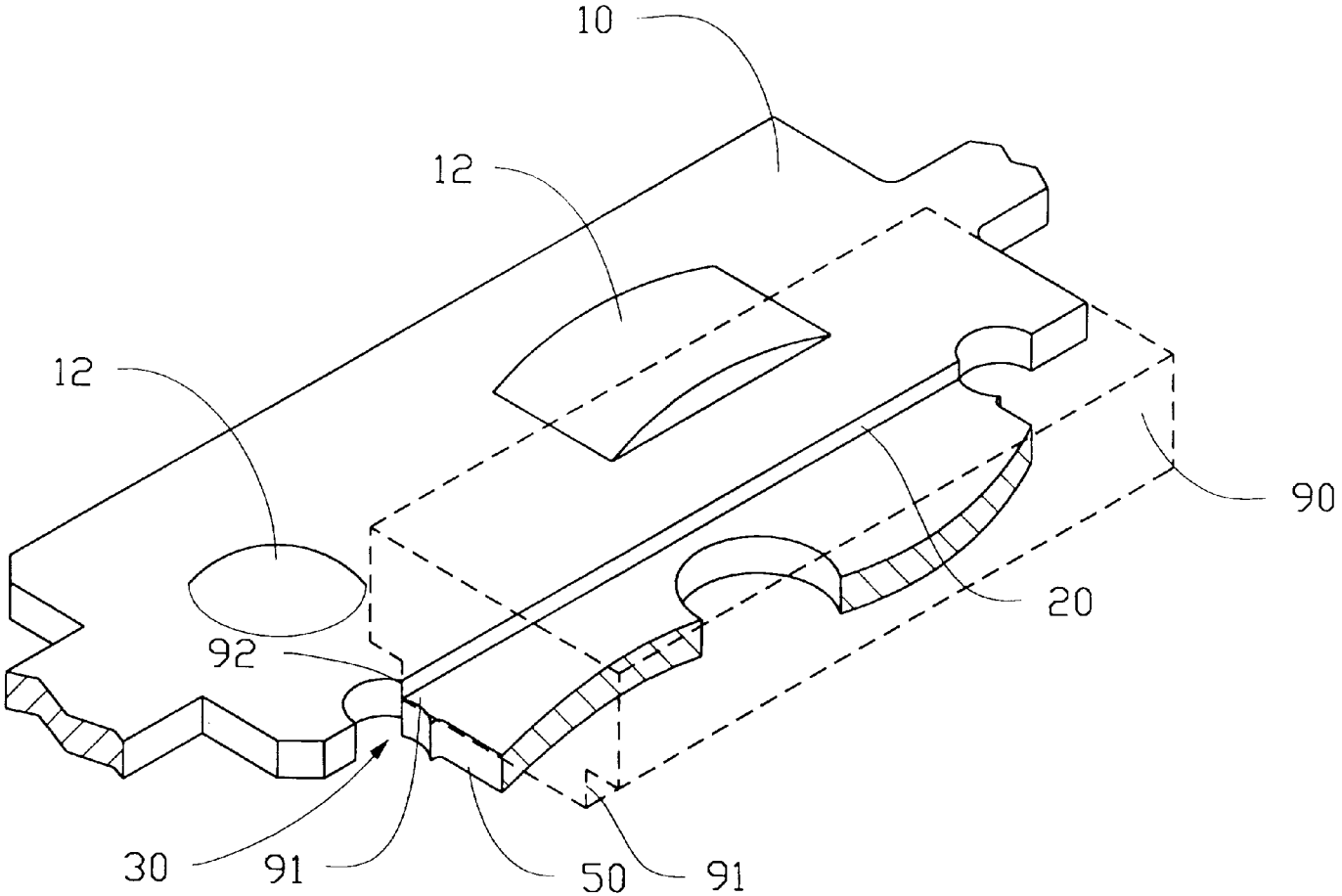
FIG. 7 is a partial, perspective view of a contact strip in accordance with the present invention showing a cutter separating a connection portion of a terminal from a material band.

The cutter 90 as shown in FIG. 7 is formed as a block having cutting edges 92 defined along opposite lower portions thereof and cutting corners 91 formed at opposite distal ends of the cutting edges 92. The distance between the cutting edges 92 is equal to the distance between adjacent terminals 10 of the contact strip. The contact strip is positioned below the cutter 90, then the cutter 90 is brought to contact the contact strip whereby the cutting corners 91 are positioned above the corresponding cutting cutouts 30. The cutting edges 92 of the cutter 90 then cut through the contact strip thereby separating adjacent terminals 10 from the adjoining band 20.

Figure 8:
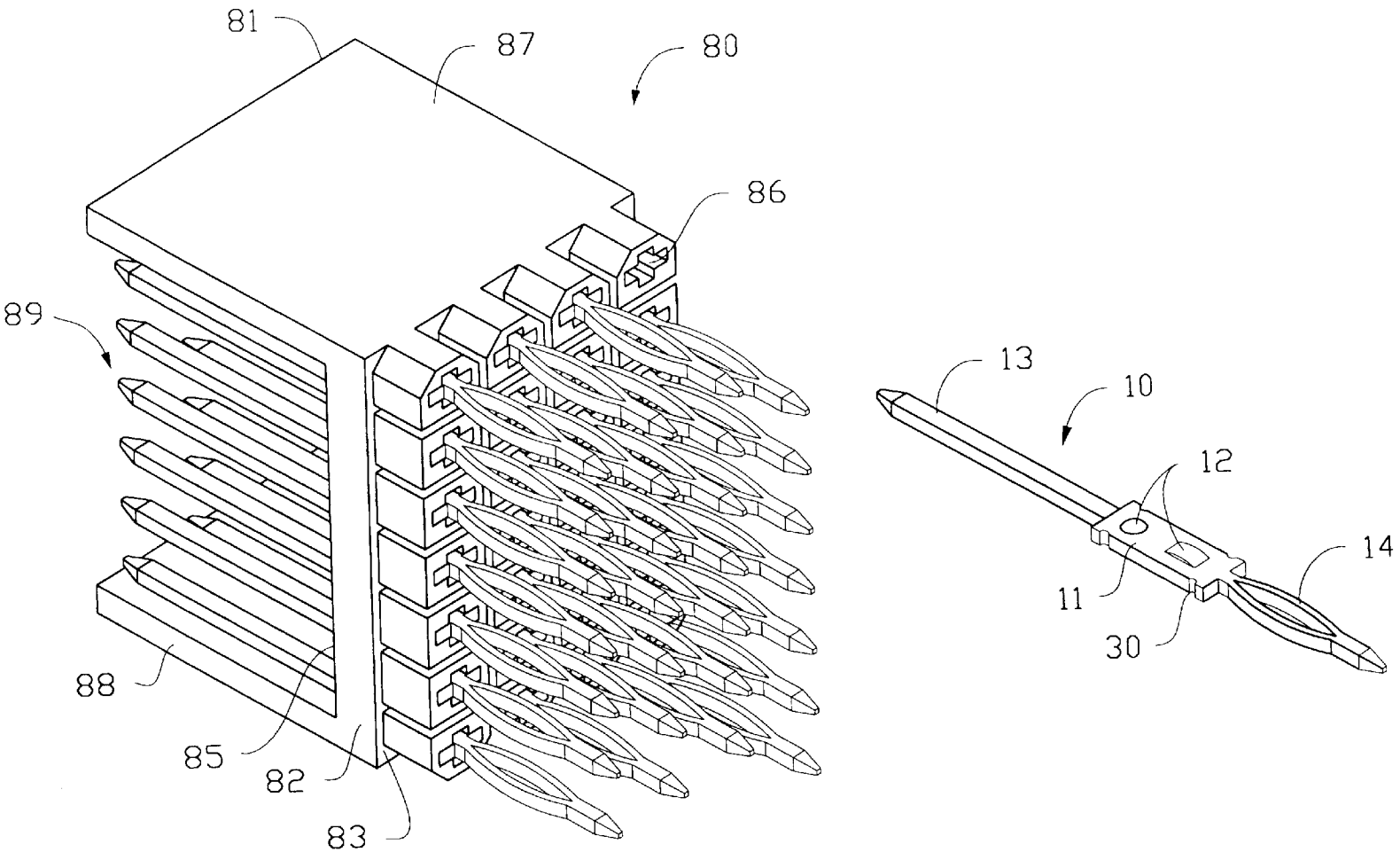
FIG. 8 is a perspective view of a connector housing showing how the terminals formed in accordance with the present invention are inserted therein.

The terminals 10 are individually received in the receptacle connector 80 as shown in FIG. 8. The connector 80 comprises an insulative housing 81 forming a base 82 with two vertical wings 87, 88 extending from distal ends of the base 82, respectively. The base 82 has a mounting face 83, a mating face 85, and a plurality of passageways 86 defined between the two faces 83, 85. A receiving space 89 for receiving a mating plug connector (not shown) is defined between the wings 87, 88 and the base 82. The first contact portions 13 of the terminals 10 are inserted into the corresponding passageways 86 through the mounting face 83 until they extend through the base 82 and project into the receiving space 89. The projections 12 of the terminals 10 interferentially engage with inner walls of the corresponding passageways 86 whereby each contact terminal 10 is securely received in the housing 81 of the connector 80.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A contact strip having a plurality of terminals joined together by a material band, each terminal including a connection portion having a first contact portion extending from one end thereof for reception in a connector and a second contact portion extending from another end thereof for engagement with a PCB the connection portions being joined together by the material band, ends of the connection portion defining a pair opposite cutting cutouts therein adjacent to the material band, said cutting cutouts allowing a cutter to separate the terminals from the material band by cutting through the contact strip along one straight line defined between the cutting cutout at one end of the connection portion and the corresponding cutting cutout at another end of the connection portion and located inside an outermost edge of the connection portion thereby facilitating the separation of the terminals from the contact strip.

2. The contact strip as described in claim 1, wherein each connection portion forms two projections thereon for interferential engagement with the connector.

3. The contact strip as described in claim 1, wherein each material band defines a guiding hole therein for properly aligning the contact strip with the cutter before separating the terminals therefrom.

4. A process of separating terminals from a contact strip by means of a cutter, the terminals joined together by a material band, each terminal including a connection portion having a first contact portion extending from one end thereof for reception in a connector and a second contact portion extending from another end thereof for engagement with a PCB, each end of the connection portion defining a pair of opposite cutting cutouts therein adjacent to the material band whereby the cutter separates the terminals from the contact strip by cutting along a straight line between two cutting cutouts defined along a shared longitudinal edge of the connection portion, the straight line being located inside an outermost edge of the connection portion.

5. The process as described in claim 4, wherein each material band defines a guiding hole therein for properly aligning the contact strip with the cutter before separating the terminals therefrom.

6. The process as described in claim 4, wherein the cutter is formed as a block having cutting edges defined along opposite lower portions thereof and cutting corners formed at opposite distal ends of the cutting edges.

7. The process as described in claim 6, wherein the distance between the cutting edges is equal to the distance between adjacent terminals of the contact strip.

8. The process as described in claim 6, wherein after the contact strip is positioned below the cutter, the cutter is brought to contact the contact strip whereby the cutting corners are positioned above the corresponding cutting cutouts.

9. The process as described in claim 8, wherein the cutting edges of the cutter cut through the contact strip along the straight line thereby separating adjacent terminals from the material band.

10. An arrangement of producing a plurality of terminals from a contact strip, comprising: terminals joined together by a material band, each terminal including a connection portion which is connected to a material band and is adapted to be separated therefrom along two opposite predetermined lines, a pair of cutoffs formed in the connection portion at either distal end of the each of said two corresponding lines adjacent to the material band for facilitating the separation of the terminals from the contact strip by means of a cutter along said line; wherein said connection portion is positioned between a first contact portion extending from one end thereof and adapted to be received within a receptacle connector, and a second contact portion extending from another end of thereof opposite to said first contact portion and adapted to be engaged with a printed circuit board, and said pair of cutoffs are positioned adjacent to said two ends thereof.

* * * * *